US007513786B2

(12) United States Patent
Muroi et al.

(10) Patent No.: US 7,513,786 B2
(45) Date of Patent: Apr. 7, 2009

(54) CONNECTOR, CIRCUIT BOARD AND ELECTRONIC APPARATUS

(75) Inventors: Hiroyuki Muroi, Kawasaki (JP); Koki Takahashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/005,321

(22) Filed: Dec. 27, 2007

(65) Prior Publication Data

US 2008/0108235 A1 May 8, 2008

Related U.S. Application Data

(63) Continuation of application No. PCT/JP2005/011910, filed on Jun. 29, 2005.

(51) Int. Cl.
*H01R 13/64* (2006.01)

(52) U.S. Cl. ..... 439/248

(58) Field of Classification Search ..... 439/247, 439/248, 79

See application file for complete search history.

(56) References Cited

U.S. PATENT DOCUMENTS 3,982,806 A * 9/1976 Wilson et al. ..... 439/248
5,201,663 A 4/1993 Kikuchi et al.

FOREIGN PATENT DOCUMENTS

JP 04-370677 A 12/1992
JP 07-267020 A 10/1995
JP 2002-093531 A 3/2002
JP 2002-208461 A 7/2002

* cited by examiner

*Primary Examiner*—Javaid Nasri
(74) *Attorney, Agent, or Firm*—Arent Fox LLP

(57) ABSTRACT

The present invention improves a buffer function of a connector (22) against impact from a plug (36). A connector that is connected with uniting to a plug has a first housing (an inner shell 24) that is connected to the plug and a second housing (an outer shell 26) that surrounds the first housing (the inner shell 24) with being installed on a member to be attached (a circuit board 48). The first housing (the inner shell 24) is elastically supported inside the second housing (the outer shell 26).

9 Claims, 20 Drawing Sheets

CONNECTOR, CIRCUIT BOARD AND ELECTRONIC APPARATUS

CROSS-REFERENCE TO RELATED APPLICATIONS

This application is a continuation of International Application No. PCT/JP2005/011910, filed on Jun. 29, 2005, now pending, herein incorporated by reference.

BACKGROUND OF THE INVENTION

1. Field of the Invention

The present invention relates generally to structure of a connector that is connected with uniting to a plug, and particularly to a connector having a buffer function of stress operating on the connector via a connection cable, etc., a circuit board and an electronic apparatus that include the connector.

2. Description of the Related Art

Connectors are used for connection between electronic apparatuses such as personal computers and peripheral devices thereof. The connectors are attached to, for example, boards of electronic apparatuses. Plugs of cables extracted from external devices are inserted to connectors. Thus, connection between electronic apparatuses and peripheral devices is carried out.

In relation to connectors as described above, connector structure including two housing structure is disclosed, the connector structure preventing connectors from breakage and degradation in performance by applied force in case that mating plugs are removed (pulled out) (Japanese Patent Application Laid-Open Publication No. H4-370677 (Paragraph 0010, FIG. 1, etc.)).

By the way, exemplary fixing structure of a connector connecting an electronic apparatus and a peripheral device will now be described with reference to FIGS. 1 and 2. FIG. 1 shows connector structure viewed from a plug attachable and detachable outlet and FIG. 2 shows fixing structure of a connector viewed from a side.

To fix a connector 4 on a built-in board 2 in an electronic apparatus, reinforce terminals 8 and 10 and a signal terminal 12, equipped in a shell 6 of the connector 4, are used (FIG. 2). That is, the reinforce terminals 8 and 10, which are prominent downward the shell 6 with giving rise to the cuts from each side of the shell 6 of the connector 4, penetrate the board 2. Which enables the reinforce terminals to be soldered at the back side of the board 2 to unify the shell 6 with the board 2 by solder parts 14 and 16. The signal terminal 12, which is prominent in the back side of the shell 6, is soldered on a conductor pattern of the board 2. This solder part 18 fixes the shell 6 to the board 2. Such a plurality of the solder parts 14, 16 and 18 firmly fix the connector 4 to the board 2.

In such fixing structure, the fixing intensity of the connector 4 to the board 2 is high and the reliability of electric connection between the connector 4 and board 2 is also high. However, when the electronic apparatus is carried with a plug being fit to the connector 4, the connector 4 results receiving external impact directly. If the connector 4 receives such impact, when the impact is exceeding, there is a risk that breakage in the connector 4, or separation or cracks, etc. in the solder parts 14, 16 and 18 that fix the connector 4 to the board 2 happens.

In Japanese Patent Application Laid-Open Publication No. H4-370677, there is no disclosure concerning the above problem, and no suggestion or disclosure about structure to solve the problem is presented, either.

In Japanese Patent Application Laid-Open Publication No. H4-370677, a connector having structure of first and second housing parts is disclosed. It is merely disclosed that the second housing part is set to be movable toward the first housing part; in case of fitting a plug, the second housing part is pushed down to prevent a contact from applied exceeding force; and in case of removing the plug, the second housing part is transformed to prevent the contact from breakage.

SUMMARY OF THE INVENTION

An object of the present invention is to improve a buffer function against impact from a plug, concerning a connector.

Described more particularly, the object thereof is to buffer impact from a plug to improve the reliability of connection.

Another object of the present invention is to improve the reliability of connection of a connector, concerning an electronic apparatus using a connector.

In order to achieve the above objects, according to a first aspect of the present invention there is provided a connector that is connected with uniting to a plug, the connector comprising a first housing that is connected to the plug; and a second housing that surrounds the first housing with being attached to a member to be attached, wherein the first housing is elastically supported inside the second housing.

As described above, if the first and second housings form double structure by the first housing uniting with a plug and the second housing attached to a member to be attached such as a circuit board being provided, the plug is united to the first housing and the member to be attached such as a circuit board is fixed to the second housing. Therefore, it is facilitated that fixing and uniting functions are shared between the first and second housings. Or, since the first housing is elastically supported to the second housing and can move slightly, impact from the plug can be absorbed and buffered by the first housing as the fixing intensity with the member to be attached is maintained. That is, impact from the plug does not directly operate on the second housing and a fixing part thereof to reinforce a buffer function against impact.

In order to achieve the above objects, in the connector, a single or a plurality of support members that have elasticity may be installed between the first housing and the second housing, and the first housing may be supported via the support member by the second housing. Support members may be used to make the structure of the first housing being supported toward the second housing. Either single or a plurality of the support members may be used.

In order to achieve the above objects, in the connector, the support members may be configured by an elasticity material. According to such structure, support structure of slight movability can be composed by the first housing being elastically supported to the second housing. Stress operating upon the first housing is absorbed by elasticity that the support members have, and propagation of impact to the second housing can be buffered.

In order to achieve the above objects, in the connector, the support members may connect the first housing and the second housing.

In order to achieve the above objects, in the connector, an elasticity member may be intervened between a single or a plurality of opposed walls of the first housing and the second housing.

In order to achieve the above objects, in the connector, the first housing, the second housing and the support members may be formed by a metal plate. According to such structure, each housing can be hardened by stiffness which a metal plate has, and the first housing can be supported to be movable slightly to the second housing by stiffness and flexibility which a metal plate has.

In order to achieve the above objects, in the connector, the support members may be an elastic body separated from an elasticity piece formed at the first housing or the second housing, the first housing or the second housing. According to such structure, the first housing can be supported to be movable slightly to the second housing.

In order to achieve the above objects, according to second aspect of the present invention there is provided a circuit board that includes a connector connected with uniting to a plug, the connector comprising a first housing to which the plug is fit; and a second housing that surrounds the first housing with being attached to a member to be attached, wherein the first housing is elastically supported inside the second housing. According to such structure, impact from a plug can be buffered at a connector, and a circuit board can be prevented from impact.

In order to achieve the above objects, according to a third aspect of the present invention there is provided an electronic apparatus that includes a connector connected with uniting to a plug, the connector comprising a first housing to which the plug is fit; and a second housing that surrounds the first housing with being attached to a member to be attached, wherein the first housing is elastically supported inside the second housing. According to such structure, impact from a plug can be buffered at a connector, and an electronic apparatus can be prevented from impact applied to the connector.

The features and advantages of the present invention are as follows.

(1) Impact from a plug is buffered; and a security function to prevent a connector, a connection part and fixing part thereof from breakage can be improved.

(2) The intensity of connector connection of an electronic apparatus using such connector can be improved and the reliability of connection can be improved.

Other objects, features, and advantages of the present invention will be understood more clearly by referring to the embodiments and the accompanying drawings.

BRIEF DESCRIPTION OF THE DRAWINGS

FIG. 6 shows a connector that a plug is attached to;

DETAILED DESCRIPTION OF THE PREFERRED EMBODIMENTS

First Embodiment

Figure 1:
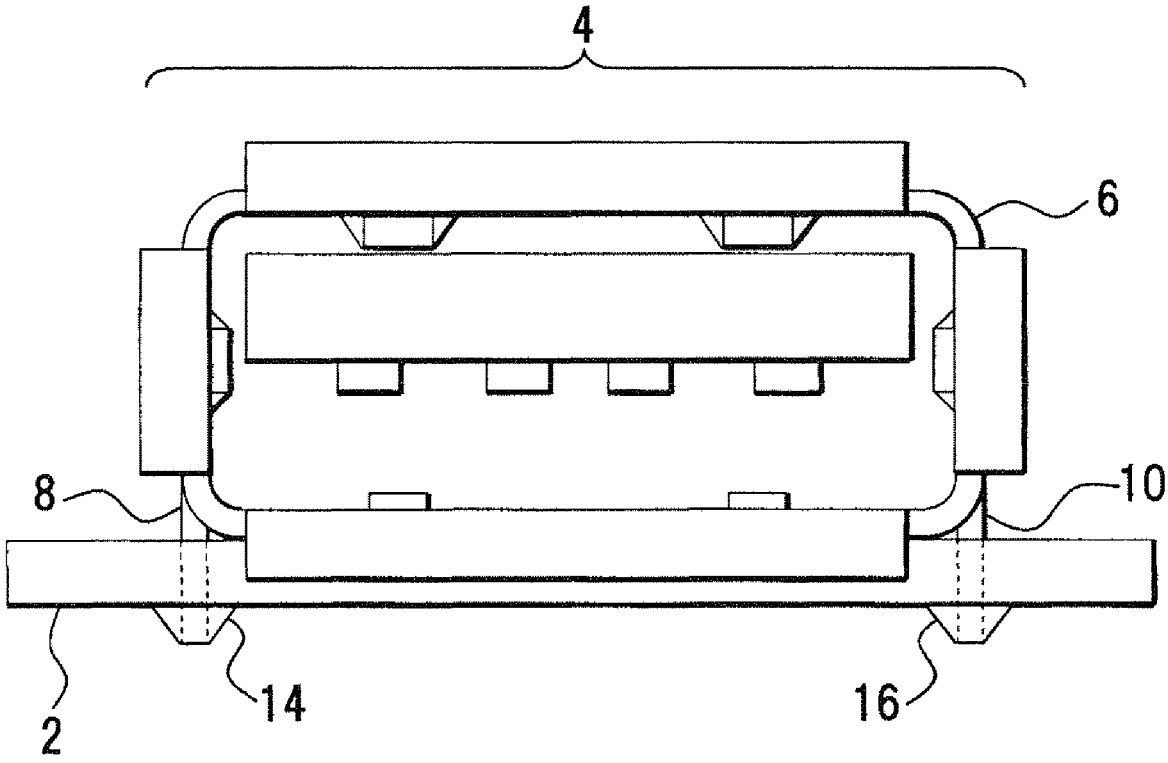
PRIOR ART FIG.1
FIG. 1 shows structure of a connector.
Figure 2:
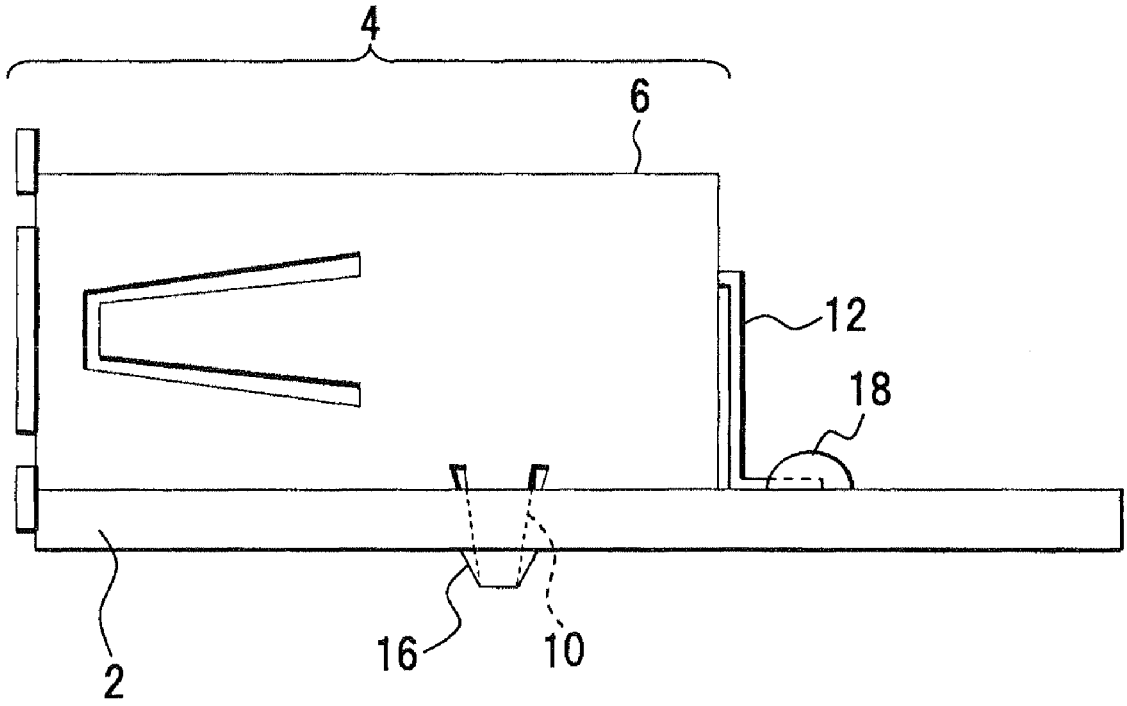
PRIOR ART FIG.2
FIG. 2 shows fixing structure of a connector.
Figure 3:
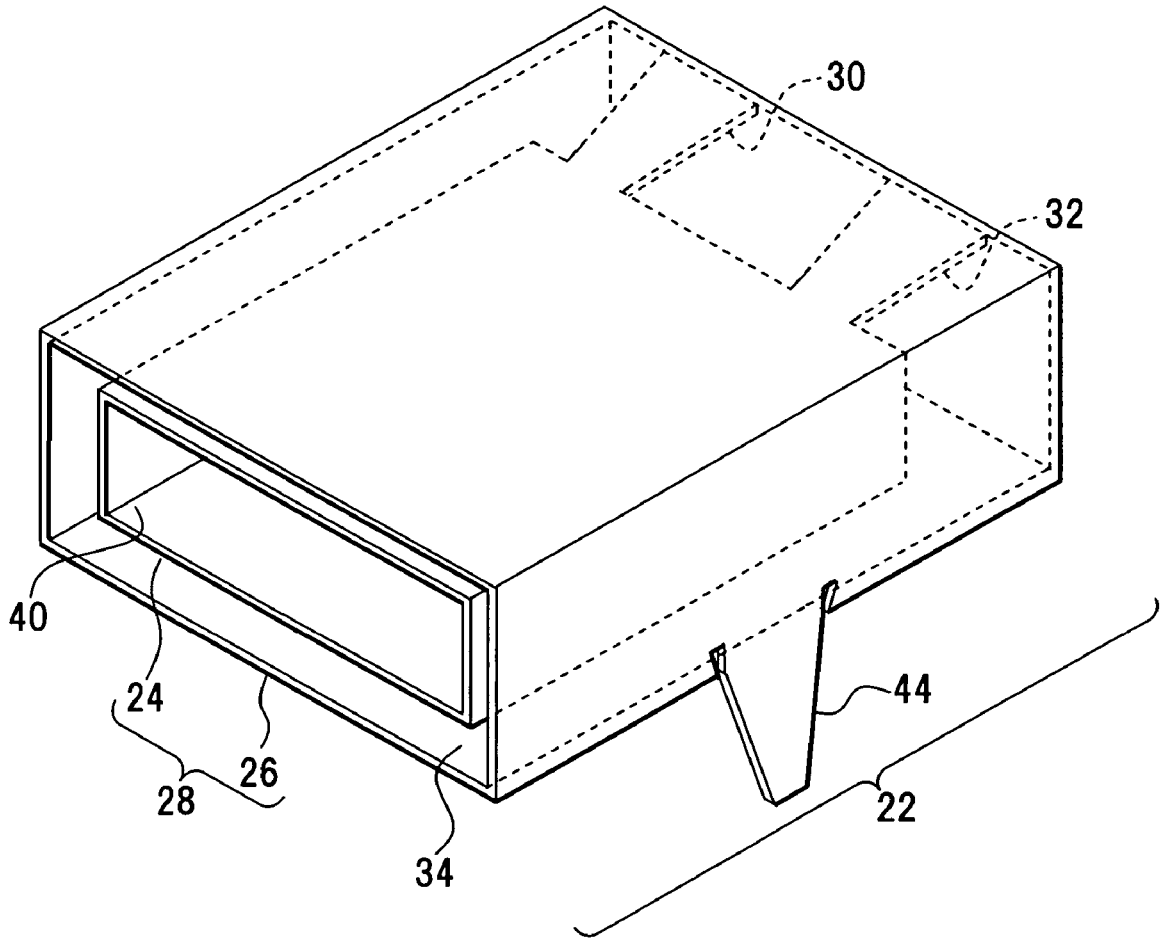
FIG. 3 is a perspective view depicting basic structure of a connector according to a first embodiment.
Figure 4:
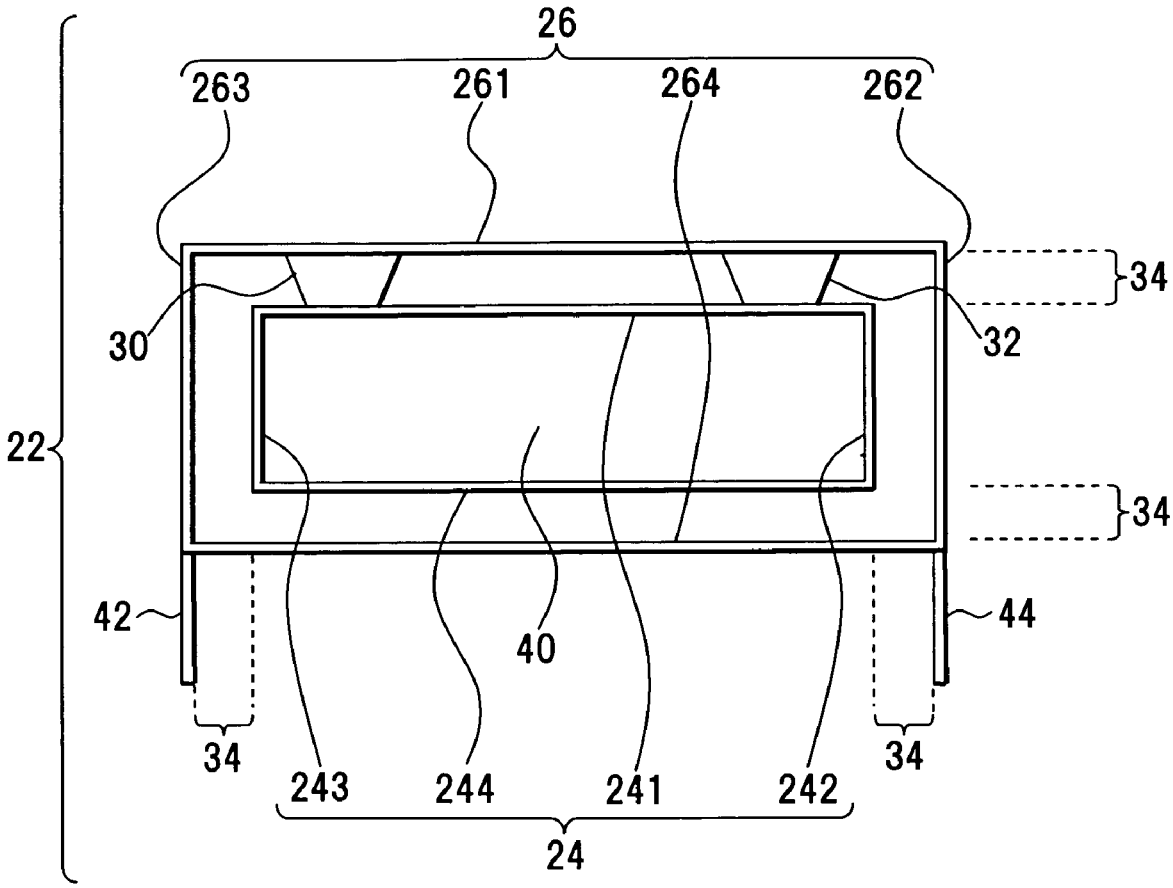
FIG. 4 is a front view depicting basic structure of a connector.
Figure 5:
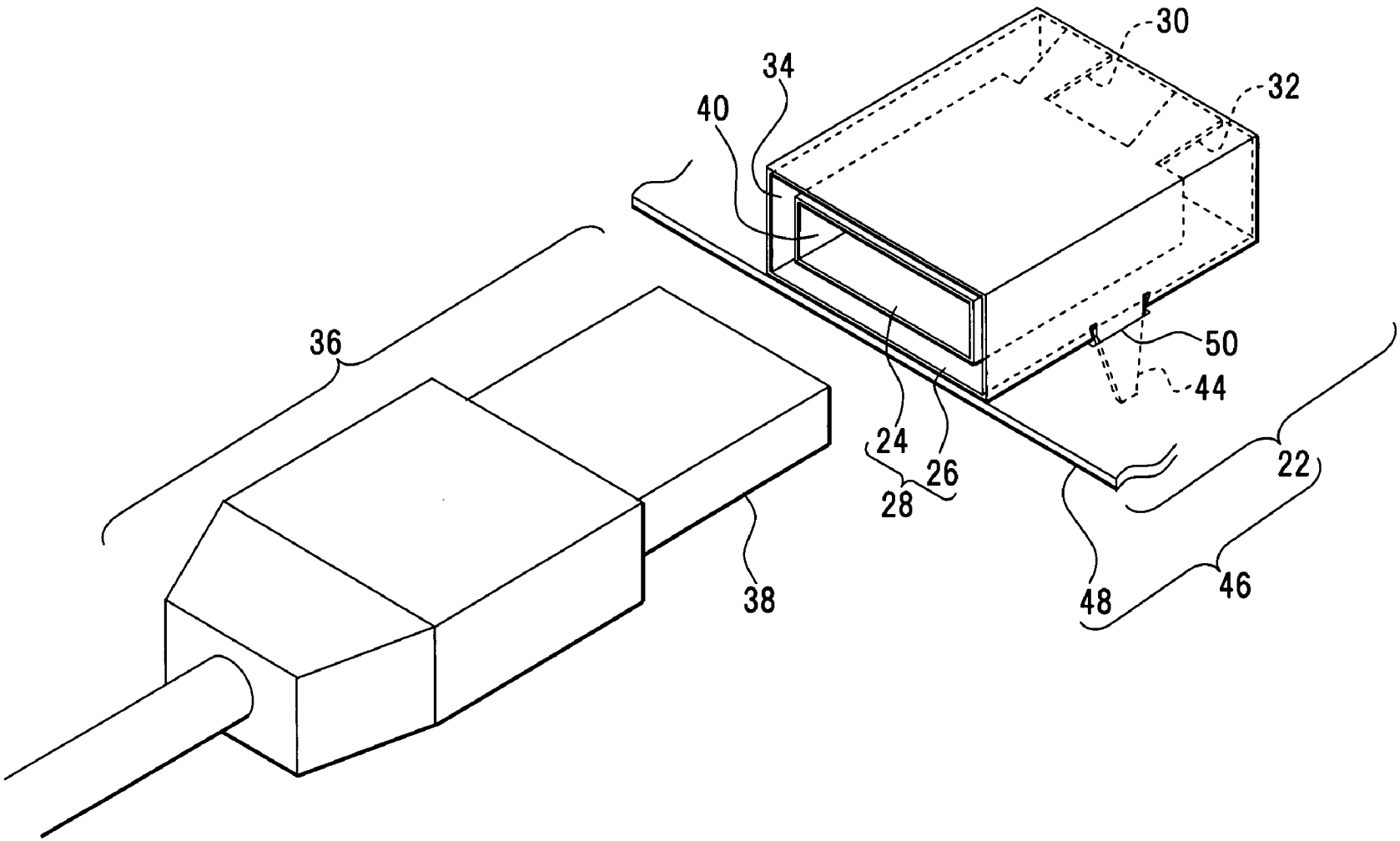
FIG. 5 is a perspective view depicting a circuit board mounted with a connector, a plug and an electronic apparatus.
Figure 6:
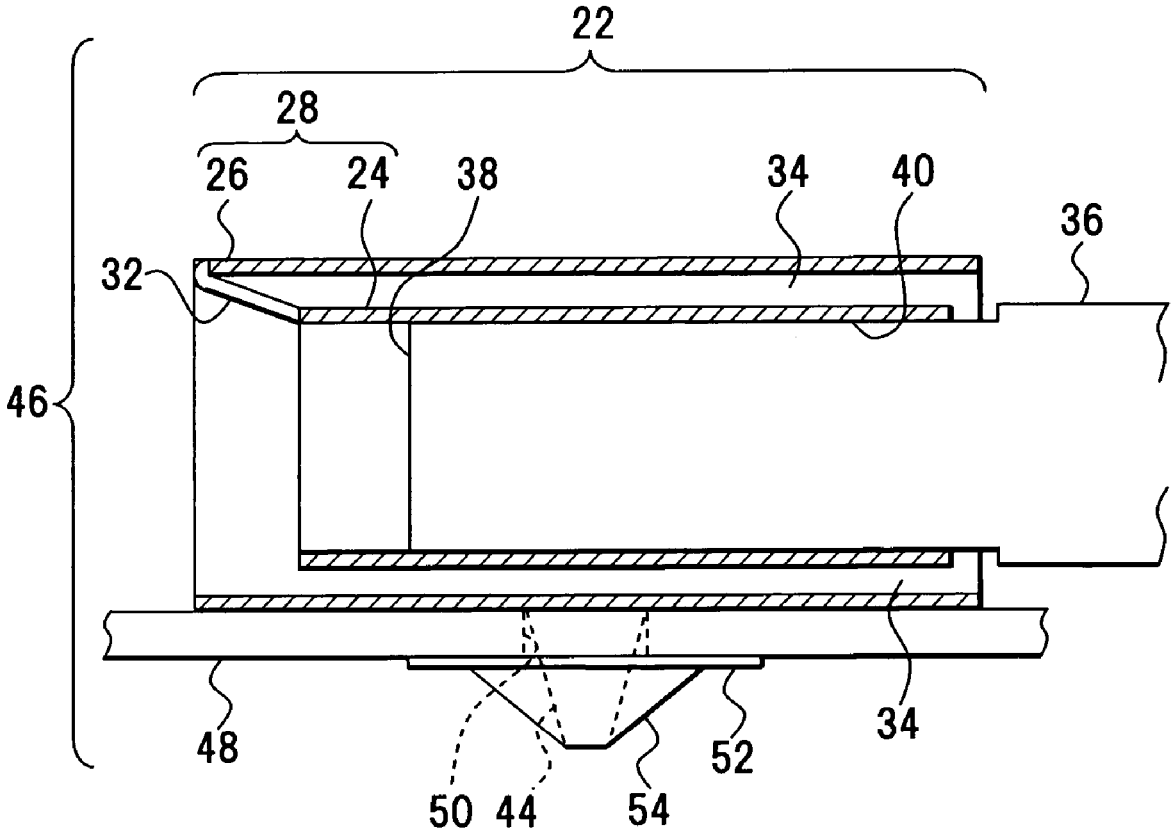
Figure 7A:
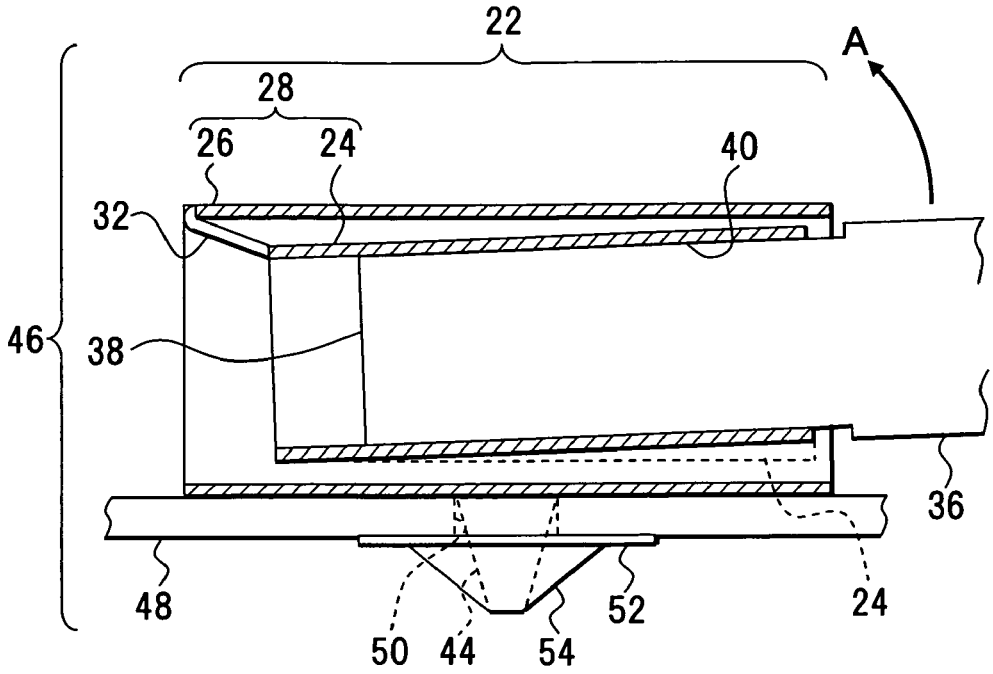
FIGS. 7A and 7B show a buffer function of a connector against external force.

A first embodiment of the present invention will now be described with reference to FIGS. 3 to 8. FIG. 3 is a perspective view depicting basic structure of a connector according to the first embodiment, FIG. 4 is a front view depicting a housing of a connector, FIG. 5 shows a circuit board mounted with a connector and a plug, FIG. 6 shows a connector to which a plug is united and FIGS. 7A to 8 show a buffer function against external impact.

This connector 22 includes a housing 28, which is composed of an inner shell 24 as a first housing and an outer shell 26 as a second housing, and the outer shell 26 is disposed with surrounding the inner shell 24. So, the housing 28 is double structure that is composed of the inner shell 24 and the outer shell 26. The inner shell 24 is supported at the back of the outer shell 26 by, for example, support parts 30 and 32 as a single or a plurality of support members that are set at the back of the inner shell 24. That is, support structure of the inner shell 24 is cantilever structure. Clearance 34 exists between the inner shell 24 and the outer shell 26. Particularly, the clearance 34 exists respectively between a ceiling part 241 and a ceiling part 261, between a side wall part 242 and a side wall part 262, between a side wall part 243 and a side wall part 263, and between a bottom part 244 and a bottom part 264 (FIG. 4). Therefore, inside the outer shell 26, the inner shell 24 is set to be movable slightly up and down or from side to side by elasticity that the support parts 30 and 32 have. In this case, the clearance 34 that is set between the inner shell 24 and outer shell 26 composes space where the inner shell 24 can move.

The inner shell 24 is a rectangular parallelepiped forming from a stiffness material such as a metal plate. An outlet 40 corresponding to an insert part 38 of a plug 36 (FIG. 5) is formed in the inner shell 24. The outer shell 26 is also a rectangular parallelepiped forming from a stiffness material such as a metal plate as well as the inner shell 24. The outer shell 26 is a similar figure to the inner shell 24.

Each support part 30 and 32 supporting the inner shell 24 at the outer shell 26 may be formed from the same structural material as or another material from the inner shell 24 and outer shell 26. If these support parts 30 and 32 are formed from a stiffness material, the described clearance 34 is ensured in an inside space part of the outer shell 26, and the inner shell 24 can be supported to be movable slightly.

A pair of fixing pieces 42 and 44 giving rise to the cuts from each side wall part 262 and 263 and the bottom part 264 is formed in the outer shell 26. Each fixing piece 42 and 44 forms into the same face as each side wall part 262 and 263 in the embodiment. Each fixing piece 42 and 44 is like a trapezoid which is wide in a root side and is narrow in a tip side, and is prominent downward the bottom part 264 of the outer shell 26.

A circuit board 48 as a member to be attached where the connector 22 is attached is disposed at an electronic apparatus 46 where the connector 22 is mounted as shown in FIG. 5. That is, in the embodiment, the connector 22 composes a receptacle connector. In the circuit board 48, a space part where the connector 22 is disposed is set and thrown holes 50 corresponding to the fixing pieces 42 and 44 are formed. Each fixing piece 42 and 44 is penetrated to each thrown hole 50 to fix a position of the connector 22. The connector 22 is disposed on the top of the circuit board 48. Each fixing piece 42 and 44 penetrating to the back side of the circuit board 48, and a conductor pattern 52 formed on the periphery of the thrown holes 50 are soldered. As shown in FIG. 6, this solder part 54 fixes the outer shell 26 of the connector 22 to the circuit board 48 firmly. Then, the insert part 38 of the plug 36 is inserted into the outlet 40 of the inner shell 24 to be able to unite the plug 36 to the connector 22.

In such structure, for example as shown in FIG. 7A, external force such as impact operates on the plug 36 united to the connector 22. If force in the direction shown by an arrow A operates on the inner shell 24 with receiving the external force, the inner shell 24, which is slightly movably supported to the outer shell 26 by the support parts 30 and 32, transfers in the direction of the arrow A. The transfer buffers the external force and the force operating on the outer shell 26 is buffered. The outer shell 26 is fixed to the circuit board 48 firmly by the solder part 54, etc. The external force is buffered in the inner shell 24 so influence of the outer force against a fixing part of the circuit board 48 and outer shell 26 is avoided.

Figure 7B:
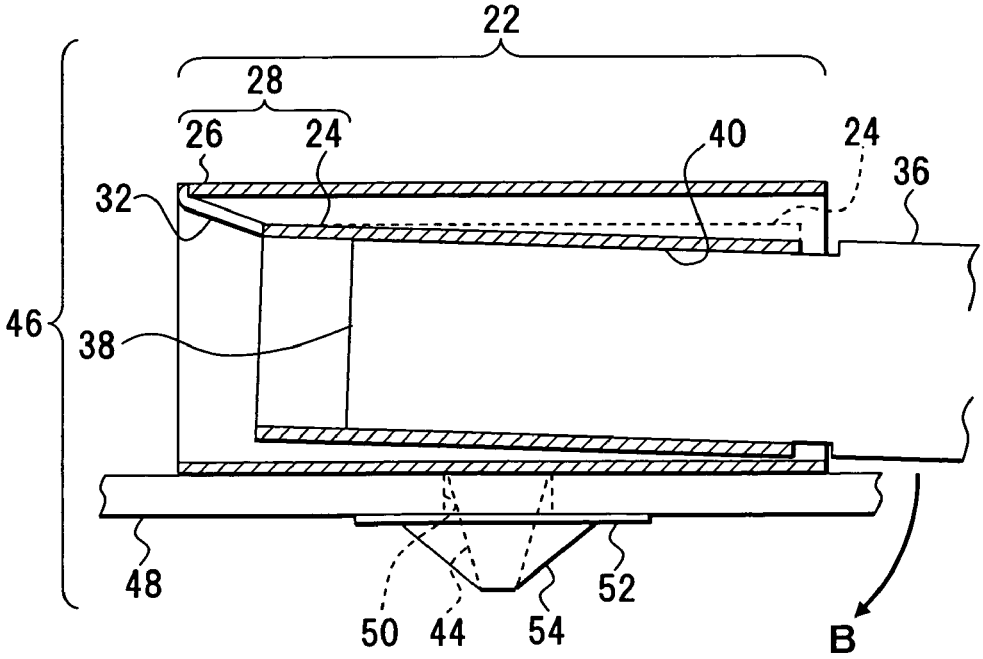
Figure 8:
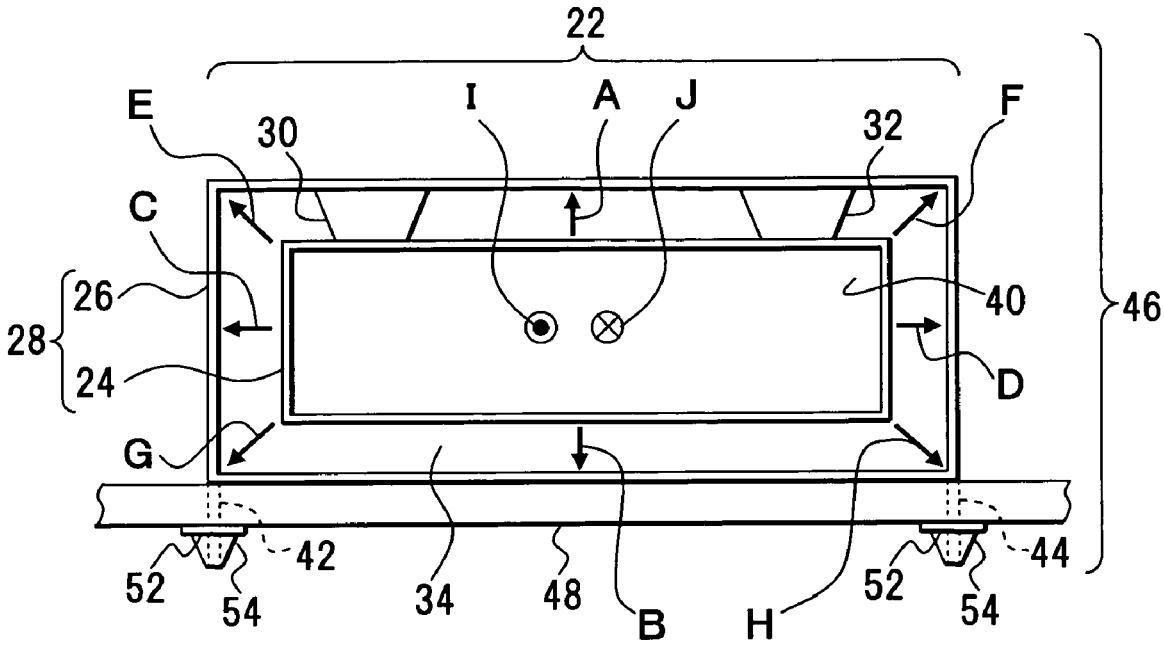
FIG. 8 shows a buffer function of a connector against external force.

As shown in FIG. 7B, external force such as impact operates on the plug 36 united to the connector 22. If force in the direction shown by an arrow B operates on the inner shell 24 with receiving the external force, the inner shell 24 transfers in the direction of the arrow B. The transfer buffers the external force and the force operating on the outer shell 26 is buffered. In this case as well, influence of the external force against a fixing part of the circuit board 48 and outer shell 26 is avoided.

Against impact operating on the inner shell 24 via the plug 36, as shown in FIG. 8, the inner shell 24 can slightly move in any of the periphery directions and directions back and forth thereof such as up and down or from side to side as shown by arrows A, B, C, D, E, F, G, H, I and J. A buffer function can be obtained against external impact in all directions and impact against the outer shell 26 is buffered.

Such buffer function can buffer exceeding stress operation against the solder part 54 of the outer shell 26 and circuit board 48. The solder part 54 that is a fixing part can be prevented from separation and cracks. Thus, the fixing intensity is attempted to increase and a state of fixing of the connector 22 can be maintained.

Second Embodiment

Figure 9:
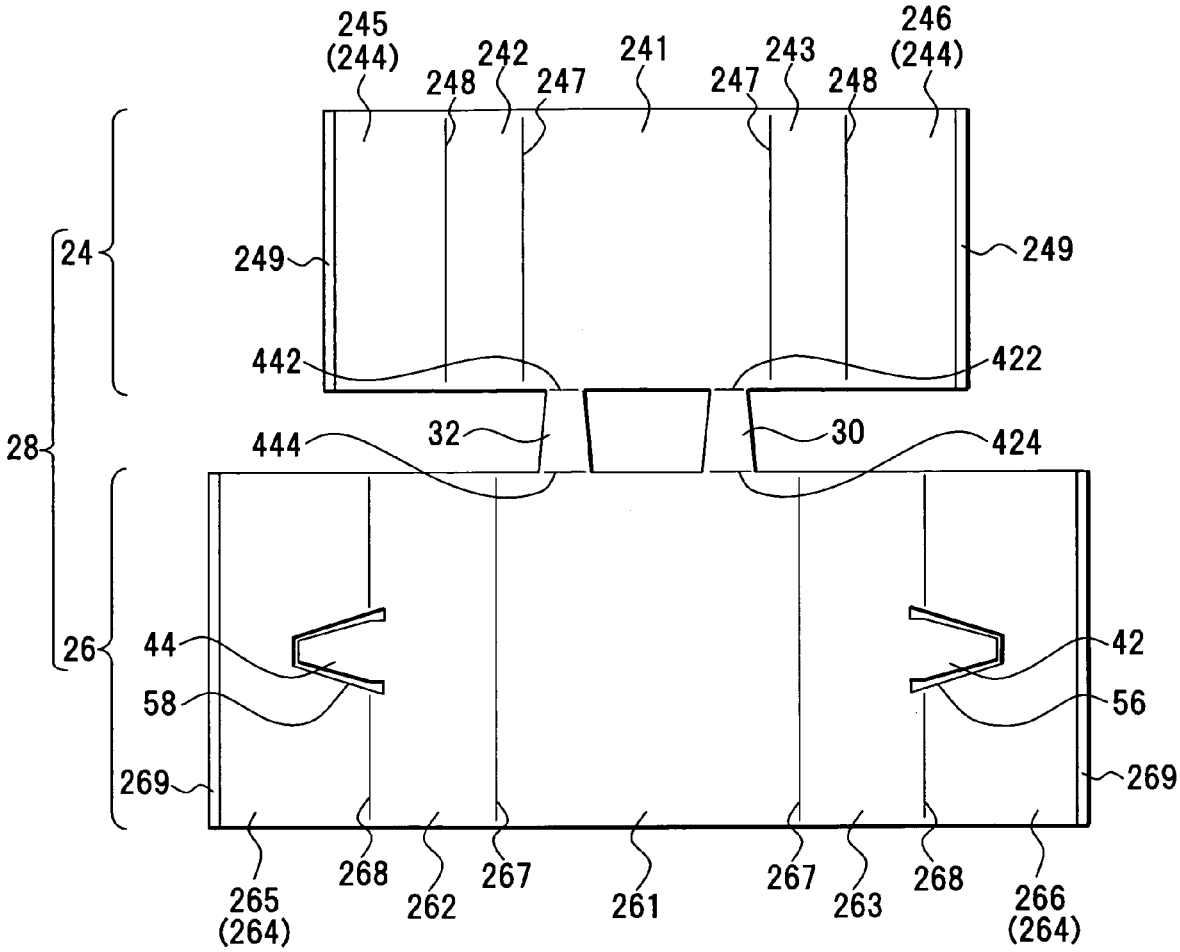
FIG. 9 is a development depicting a housing of a connector according to a second embodiment.
Figure 10:
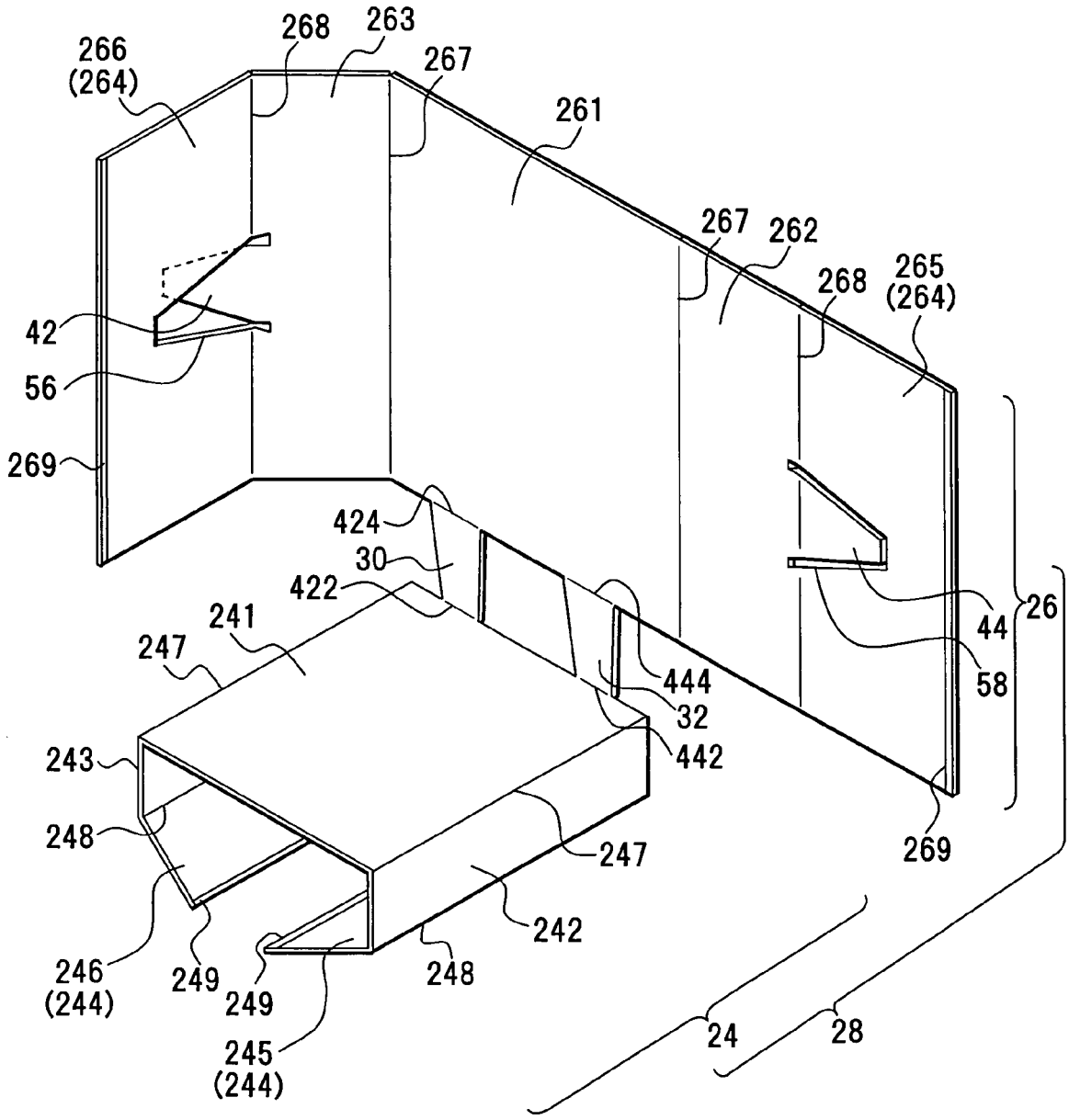
FIG. 10 shows assembly of a housing.
Figure 11:
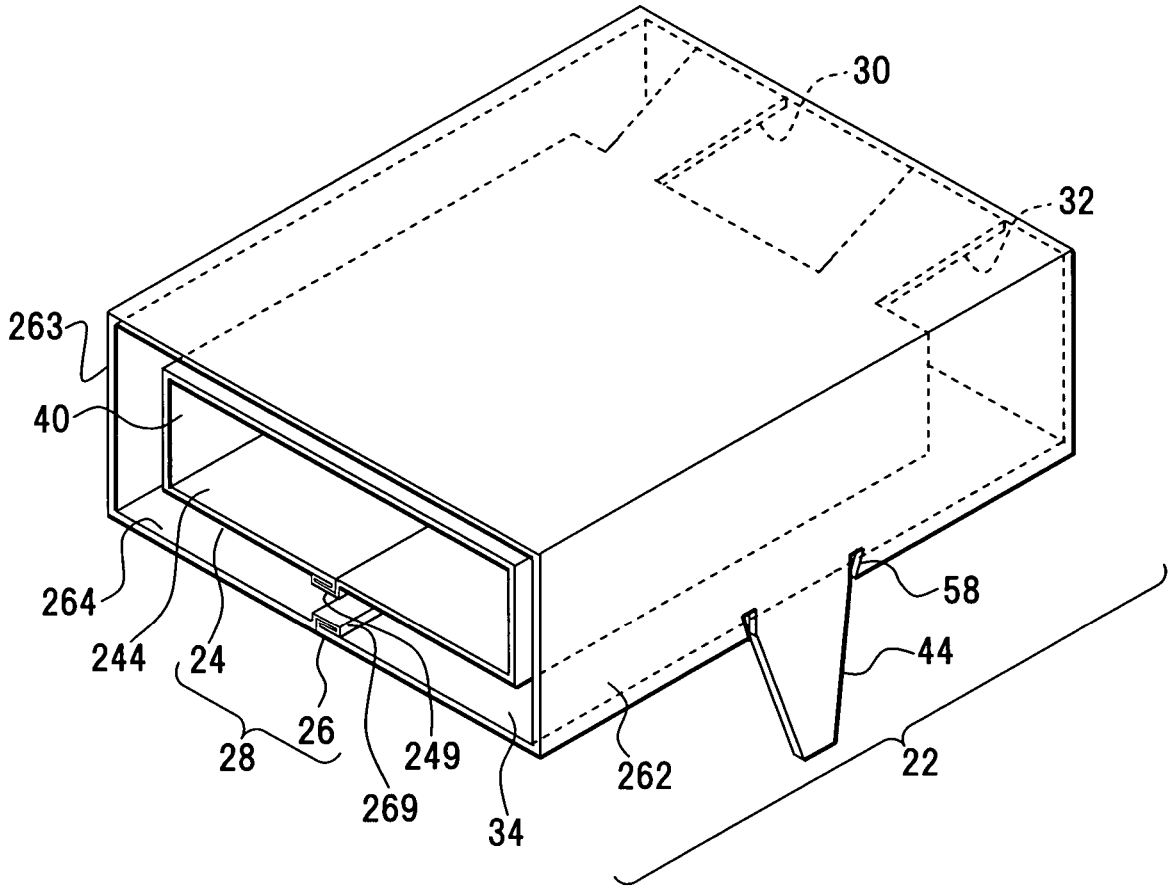
FIG. 11 shows a connector according to a second embodiment.

A second embodiment of the present invention will be described with reference to FIGS. 9 to 11. FIG. 9 is a development depicting a housing that is an example how a housing is formed, FIG. 10 shows assembly of a housing and FIG. 11 shows a housing of a connector. In FIGS. 9 to 11, the same components as described in FIGS. 3 and 4 are denoted by the same reference numerals.

The housing 28, for example, is made by plate working using a single metal plate as a stiffness material. The inner shell 24, the outer shell 26 and the support parts 30 and 32 are unified to form the housing 28.

The inner shell 24 includes the rectangular ceiling part 241, the side wall parts 242 and 243 and bottom pieces 245 and 246 of the bottom part 244. A fold part 247 is formed between the ceiling part 241 and the side wall parts 242 and 243, and a fold part 248 is formed each between the side wall part 242 and bottom piece 245, and the side wall part 243 and bottom piece 246. A crimp part 249 is formed in the bottom pieces 245 and 246 to unite both pieces by crimping.

The outer shell 26 includes the rectangular ceiling part 261, the side wall parts 262 and 263 and bottom pieces 265 and 266 of the bottom part 264. A fold part 267 is formed between the ceiling part 261 and the side wall parts 262 and 263, and a fold part 268 is formed each between the side wall part 262 and bottom piece 265, and the side wall part 263 and bottom piece 266. A crimp part 269 is formed in the bottom pieces 265 and 266 to unite both pieces by crimping.

The support parts 30 and 32 are formed between the ceiling part 241 of the inner shell 24 and ceiling part 261 of the outer shell 26 to connect the shells. Each support part 30 and 32 forms into a trapezoid whose short side is along the ceiling part 241 and long side is along the ceiling part 261. Fold parts 422 and 442 are formed between the support parts 30 and 32 and ceiling part 241, and fold parts 424 and 444 are formed between the support parts 30 and 32 and ceiling part 261.

In the bottom pieces 265 and 266, the trapezoidal fixing piece 42 surrounded by a trapezoidal slit 56 formed across the side wall parts 262 and 263, and the trapezoidal fixing piece 44 surrounded by a slit 58 are formed.

According to such structure, as shown in FIG. 10, the support parts 30 and 32 are folded in one direction, and the side wall parts 242 and 243 are folded in the opposite direction to the support parts, viewed from the ceiling part 241. The bottom pieces 245 and 246 are in opposition to each other, and each crimp part 249 is superimposed to be crimped. Thus, the rectangular parallelepiped inner shell 24 is formed. On the other hand, the side wall parts 262 and 263 and bottom parts 265 and 266 of the outer shell 26 are folded like surrounding the inner shell 24 inside, and each crimp part 269 is superimposed to be crimped. Thus, the outer shell 26 is formed.

As described above, if the inner shell 24 and the outer shell 26 are worked, as shown in FIG. 11, the housing 28 of the connector 22 is formed and the inner shell 24 is surrounded in the space part of the outer shell 26, then the inner shell 24 is supported to the outer shell 26 by the support parts 30 and 32.

Specifically, if the inner shell 24, the outer shell 26 and the support parts 30 and 32 are worked, for example, in a metal plate, formation of the inner shell 24 and the outer shell 26 is maintained by stiffness of the metal plate. Moreover, the inner shell 24 is supported to be movable slightly by the support parts 30 and 32, with elasticity that the metal plate has, in the clearance 34 that is set inside the outer shell 26.

In this case, working of formation forms the housing 28 of the connector 22, as shown in FIG. 11. The bottom part 244 is formed in the inner shell 24 by the bottom pieces 245 and 246 being crimped at the crimp part 249. The bottom part 264 is formed in the outer shell 26 by the bottom pieces 265 and 266 being crimped at the crimp part 269. The top side of the bottom part 244 becomes flat to correspond with the insert part 38 of the plug 36. The bottom side of the bottom part 264 becomes flat to mount the housing 28 on the circuit board 48. In the side wall parts 262 and 263, the fixing pieces 42 and 44 are formed in the form of extending the side wall parts 262 and 263.

In the embodiment, unifying of the housing 28 is attempted by the crimp parts 249 and 269. Instead of the crimp parts 249 and 269, fixing working such as spot weld may be used for the unifying.

Third Embodiment

Figure 12:
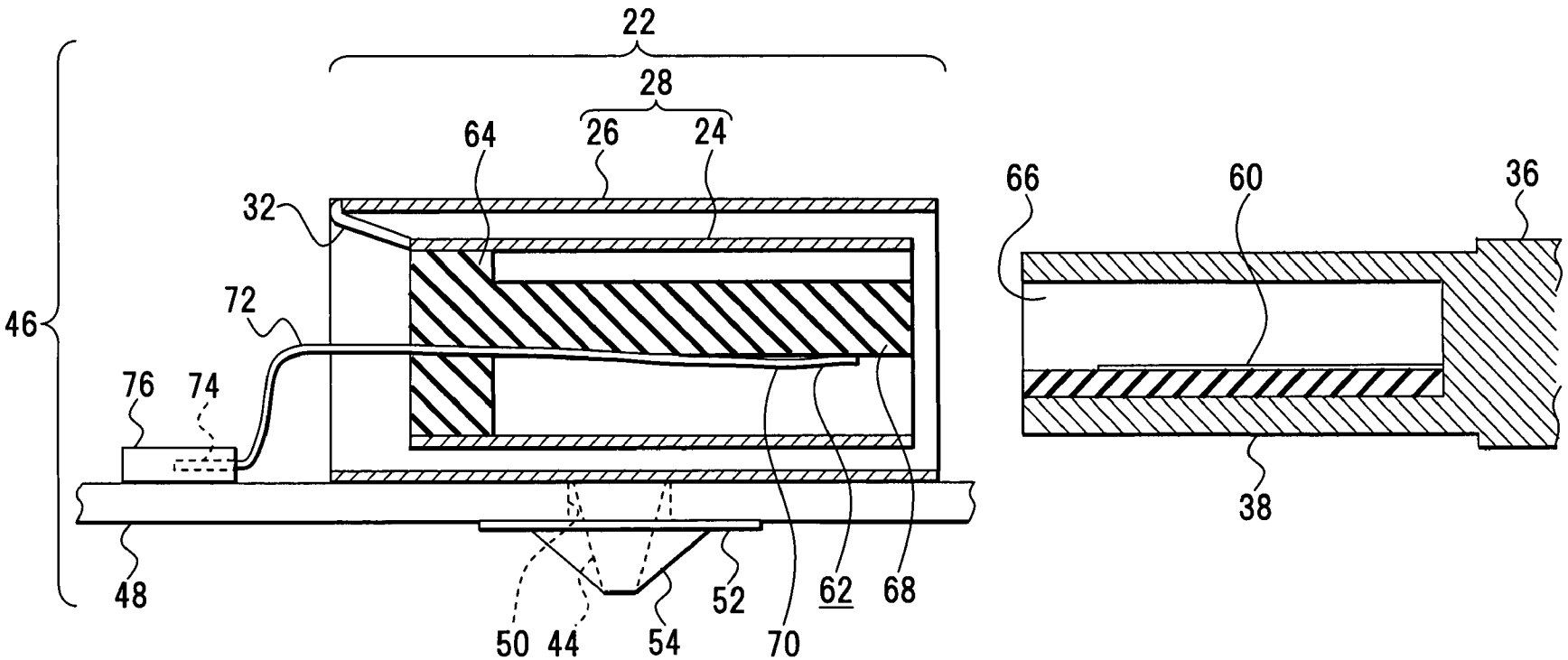
FIG. 12 shows a connector, a circuit board, an electronic apparatus and a plug according to a third embodiment.
Figure 13:
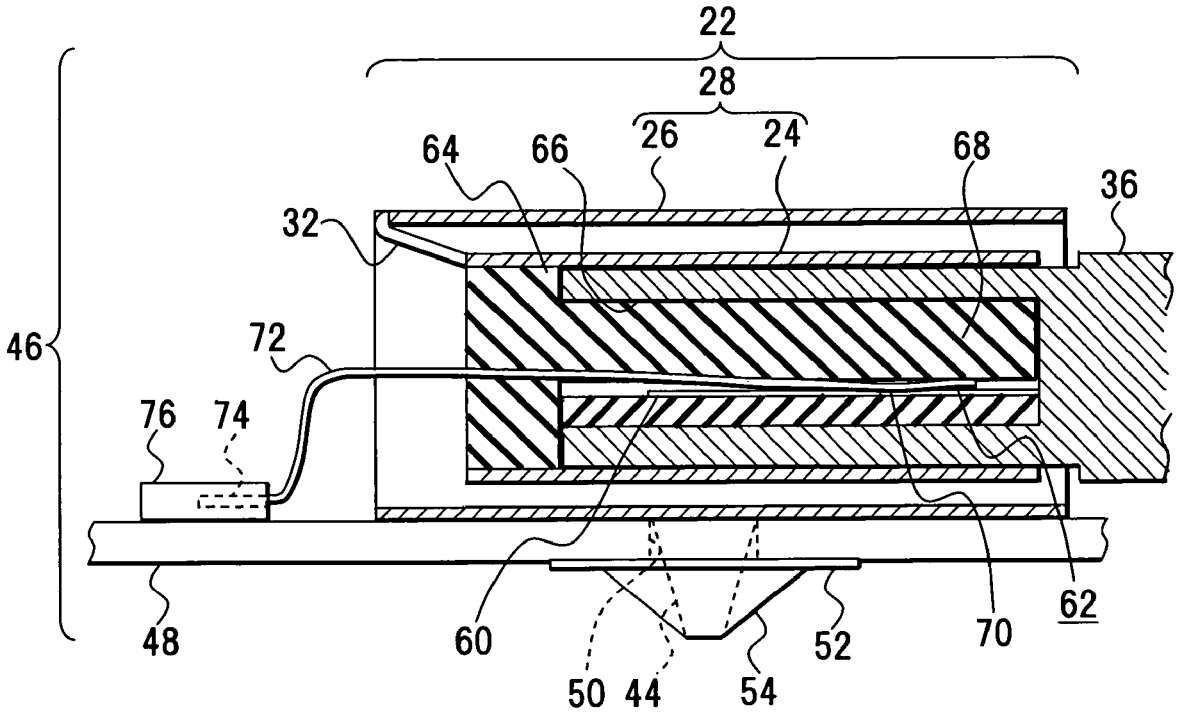
FIG. 13 shows a connector, a circuit board and an electronic apparatus depicting a state of plug attaching.

A third embodiment of the present invention will be described with reference to FIGS. 12 and 13. FIGS. 12 and 13 show connection structure of an electronic apparatus where a connector is mounted. In FIGS. 12 and 13, the same components as described in FIGS. 3 to 6 are denoted by the same reference numerals.

A contact 62 corresponding to a contact 60 of the plug 36 is set in the inner shell 24 of the connector 22. The contact 62 is set in an insulating frame part 64 fixed to the inner shell 24. A projection 68 inserted into an outlet 66 in the insert part 38 of the plug 36 is formed on the insulating frame part 64. A contact part 70 is formed by bending the contact 62. The contact 60 in the plug 36 can adhere to the contact part 70 by elasticity that a conductive material forming the contact 62 has. A wiring material 72 such as wire, FPC (Flexible print circuit), FFC (Flexible flat cable), etc. is connected to the contact 62. The wiring material 72 is extracted from the rear side of the insulating frame part 64. The contact part 74 is formed at the tip end of the wiring material 72. The contact part 74 is inserted to a connector for board connection 76 disposed on the circuit board 48 to connect the plug 36 to the connector for board connection 76 via the connector 22 electrically.

According to such structure, as shown in FIG. 13, if the insert part 38 of the plug 36 is inserted to the inner shell 24 of the connector 22, the contact 62 of the connector 22 contacts the contact 60 of the plug 36 to attempt to connect electrically, and a circuit of the plug 36 and a circuit of the circuit board 48 are connected electrically via the connector 22.

If external force such as external impact operates on the plug 36, the external force is buffered with being received by the inner shell 24 because the inner shell 24 is movable slightly (FIGS. 7A, 7B and 8). Thus, a fixing part of the outer shell 26 can be prevented from exceeding impact, and the solder part 54 can be prevented from separation and cracks.

Fourth Embodiment

Figure 14:
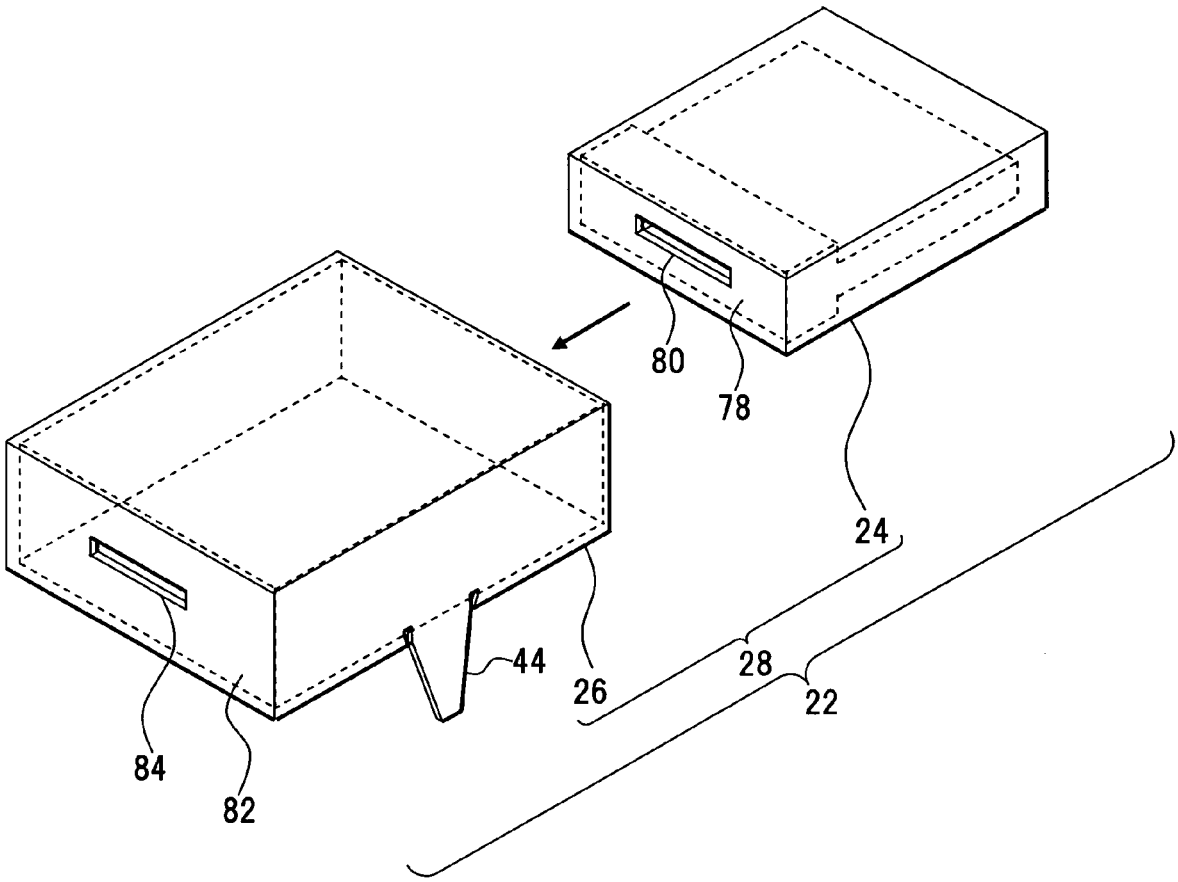
FIG. 14 is an exploded perspective view depicting a housing of a connector according to a fourth embodiment.
Figure 15:
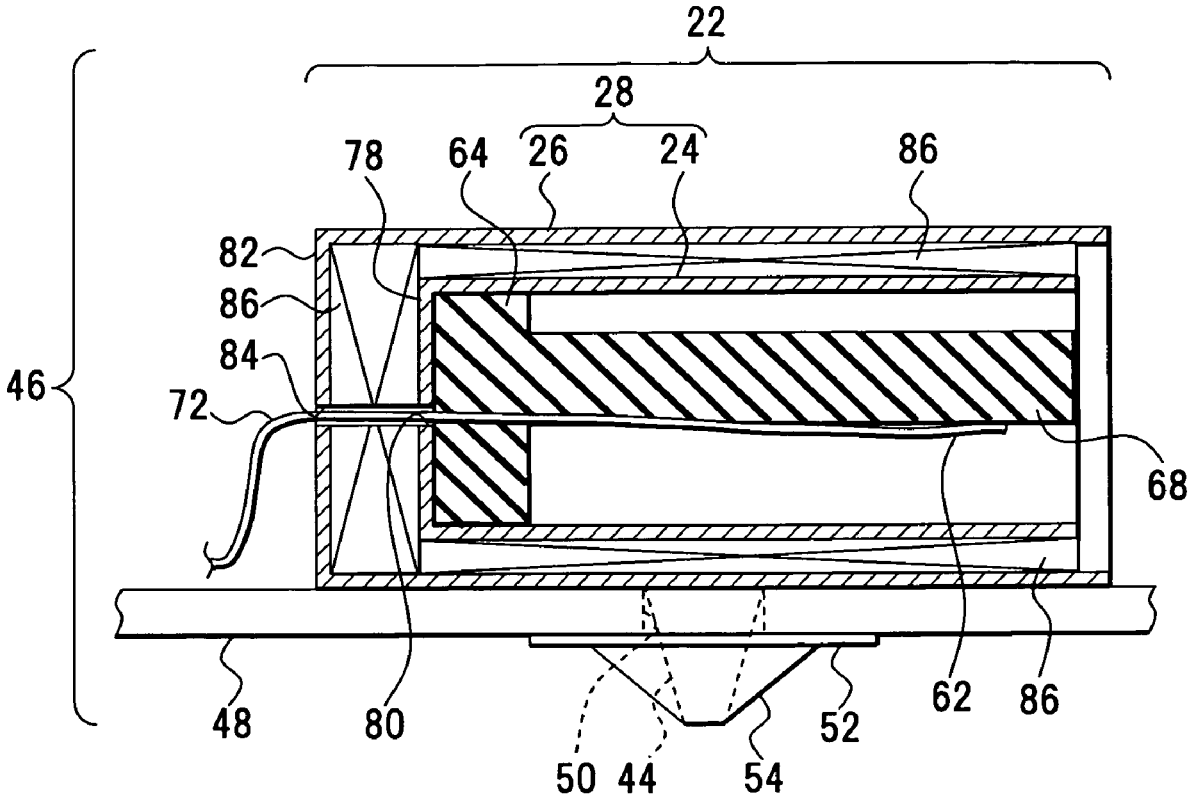
FIG. 15 shows a connector, a circuit board and an electronic apparatus.

A fourth embodiment of the present invention will be described with reference to FIGS. 14 and 15. FIG. 14 is other exemplary structure of a connector and FIG. 15 shows a connector whose inner shell adopts another support structure. In FIGS. 14 and 15, the same components as described in FIGS. 12 and 13 are denoted by the same reference numerals.

According to the above embodiments, the inner shell 24, outer shell 26 and support parts 30 and 32 of the housing 28 are constituted of a single member. In the embodiment, the inner shell 24 and the outer shell 26 are composed independently.

The back side of the inner shell 24 is blocked by a back side blockage part 78. A draw outlet 80 for the wiring material 72 is formed in the back side blockage part 78. Like the above, the back side of the outer shell 26 is blocked by a back side blockage part 82. A draw outlet 84 for the wiring material 72 is formed in the back side blockage part 82.

Inside the outer shell 26, the inner shell 24 is disposed with a single or a plurality of elasticity supporters 86 as an impact buffering unit. The elasticity supporters 86 are disposed in the clearance 34 between the inner shell 24 and outer shell 26 (FIG. 4). The elasticity supporters 86 compose support members supporting the inner shell 24 to the outer shell 26. Thus, the inner shell 24 is supported elastically to the outer shell 26 via the elasticity supporters 86 to be slightly movable.

According to such structure, mechanical intensity of the inner shell 24 can be strengthened by the back side blockage part 78, and mechanical intensity of the outer shell 26 can be strengthened by the back side blockage part 82. When the plug 36 is attached to the inner shell 24 (FIG. 13), because the inner shell 24 can move slightly by the elasticity supporter 86, external force is buffered with being received by the elasticity supporter 86 from the inner shell 24 in case that the external force such as external impact operates on the inner shell 24 from the plug 36. Thus, a fixing part of the outer shell 26 can be prevented from exceeding impact, and the solder part 54 can be prevented from separation and cracks.

Fifth Embodiment

Figure 16:
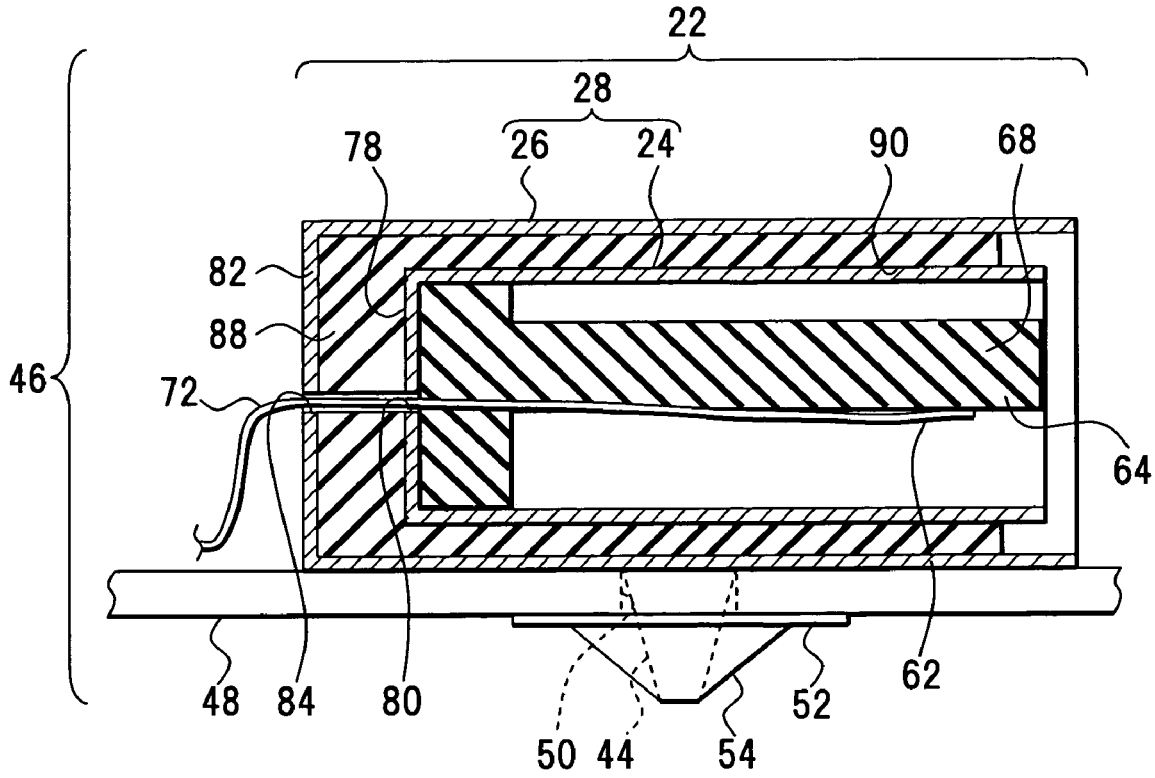
FIG. 16 shows a connector, a circuit board and an electronic apparatus according to a fifth embodiment.

A fifth embodiment of the present invention will be described with reference to FIG. 16. FIG. 16 is other exemplary structure of a connector. In FIG. 16, the same components as described in FIG. 15 are denoted by the same reference numerals.

The embodiment is concrete exemplary structure of the fourth embodiment. As to the described elasticity supporter 86, in the embodiment, the elasticity support part 88 is formed from an elasticity material such as rubber and elasticity synthetic resin. By the elasticity support part 88 being fixed inside the outer shell 26, and the inner shell 24 being disposed in a depressed part 90 formed in the elasticity support unit 88, the inner shell 24 is disposed to the outer shell 26 to be movable slightly by using elasticity that the elasticity support unit 88 has.

In case that external force such as external impact operates on the inner shell 24 from the plug 36, the external force is buffered with being received by the elasticity support part 88 from the inner shell 24. Thus, a fixing part of the outer shell 26 can be prevented from exceeding impact, and the solder part 54 can be prevented from separation and cracks.

Sixth Embodiment

Figure 17:
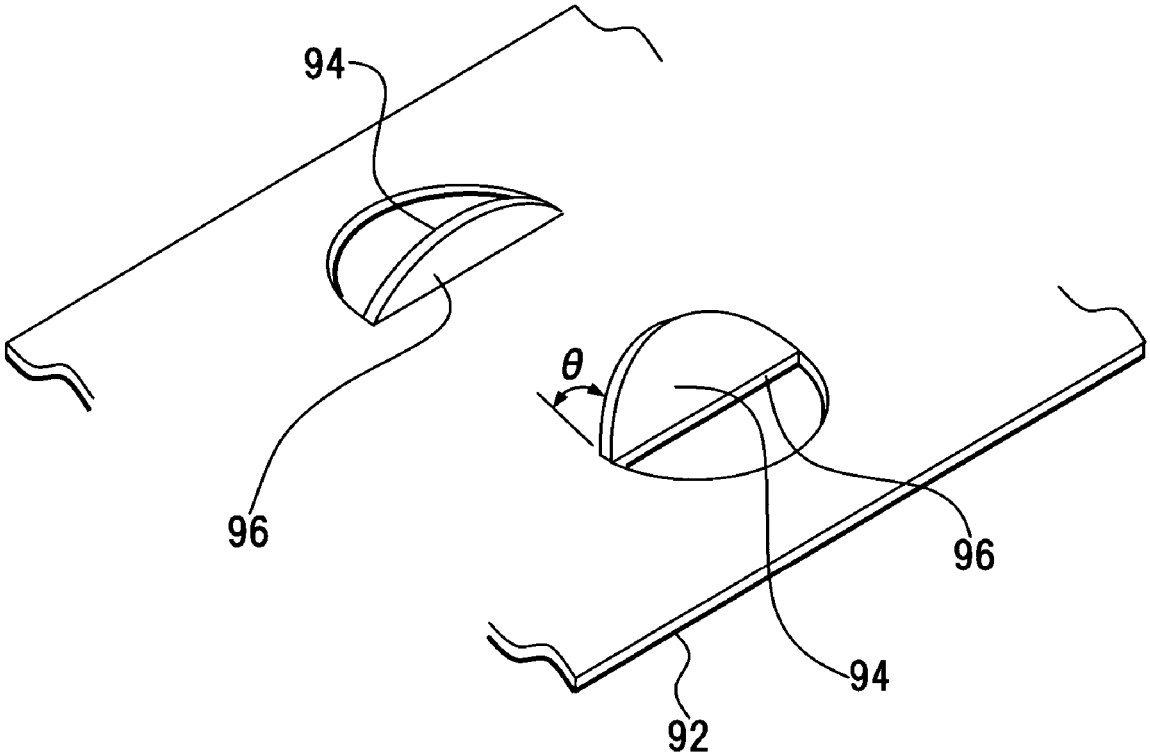
FIG. 17 shows structure of giving rise to the cuts used for a connector according to a sixth embodiment.
Figure 18:
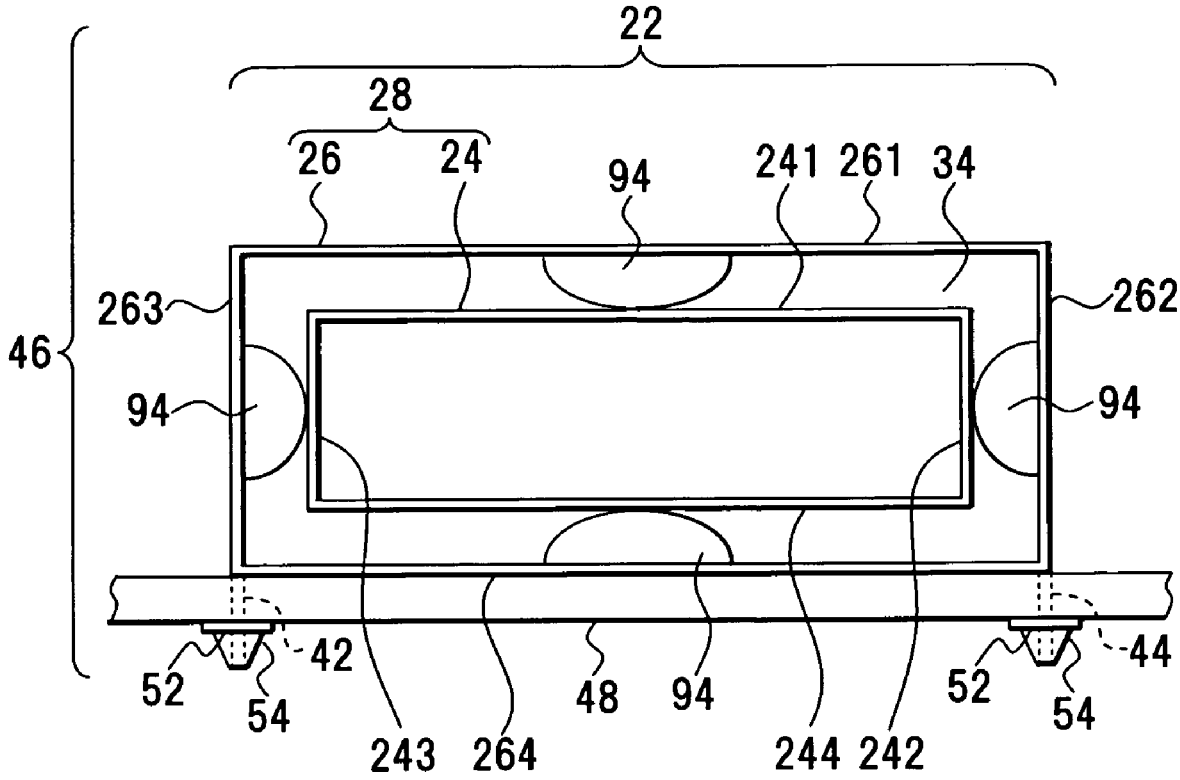
FIG. 18 shows a connector, a circuit board and an electronic apparatus according to the sixth embodiment.
Figure 19:
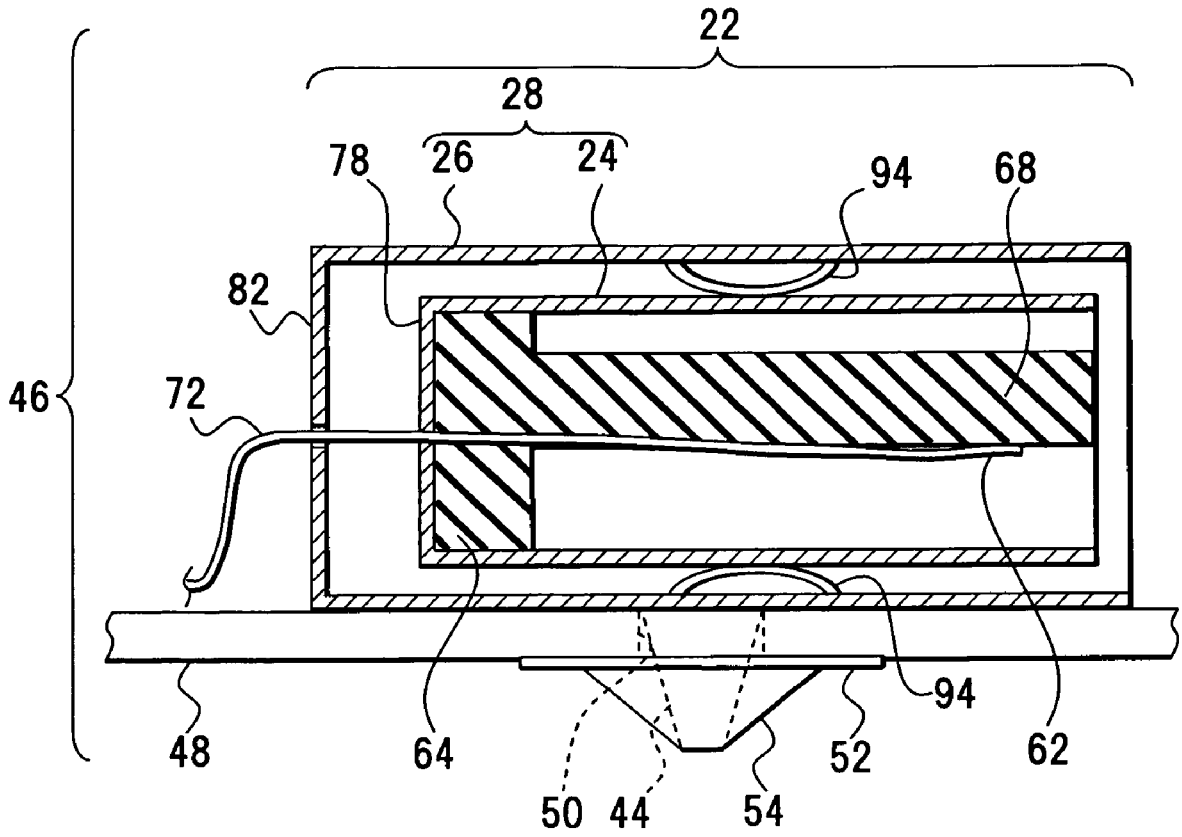
FIG. 19 shows a connector, a circuit board and an electronic apparatus.

A sixth embodiment of the present invention will be described with reference to FIGS. 17 to 19. FIG. 17 shows a support unit that is giving rise to the cuts and is formed in a metal plate, FIG. 18 shows other exemplary structure of a connector and FIG. 19 shows a sectional view of a connector. In FIGS. 17 to 19, the same or corresponding components as described in FIGS. 4 and 15 are denoted by the same reference numerals.

As shown in FIG. 17, if a metal plate 92 as a stiffness material used in working the housing 28 is stamped to form, for example, giving rise to the cuts parts 94 as support members and as elasticity pieces, each giving rise to the cuts part 94 can get flexibility by angle θ formed by the giving rise to the cuts part 94 and the surface of the metal plate 92, due to elasticity of a bend part 96 of each of the giving rise to the cuts parts 94 together with that of the metal plate 92. The elasticity can be used in elastic support of the inner shell 24 and outer shell 26 of the housing 28.

As shown in FIGS. 18 and 19, if the giving rise to the cuts part 94 is formed at each of the ceiling part 261, side wall parts 262 and 263, and bottom part 264 of the outer shell 26; and the clearance 34 is set by angle adjustment of each giving rise to the cuts part 94, the inner shell 24 can be supported to be movable slightly inside the outer shell 26. The giving rise to the cuts part 94 of the connector 22 shown in FIG. 18 and that shown in FIG. 19 are in orthogonal relationship with each other. The giving rise to the cuts part 94 in any direction can support the inner shell 24 to the outer shell 26 with being movable slightly.

According to such structure, in case that external force such as external impact operates on the inner shell 24 from the plug 36 attached to the inner shell 24, the external force is buffered with being received from the inner shell 24 by flexibility that is set with angle θ of the giving rise to the cuts parts 94. Thus, a fixing part of the outer shell 26 can be prevented from exceeding impact, and the solder part 54 can be prevented from separation and cracks.

Seventh Embodiment

Figure 20:
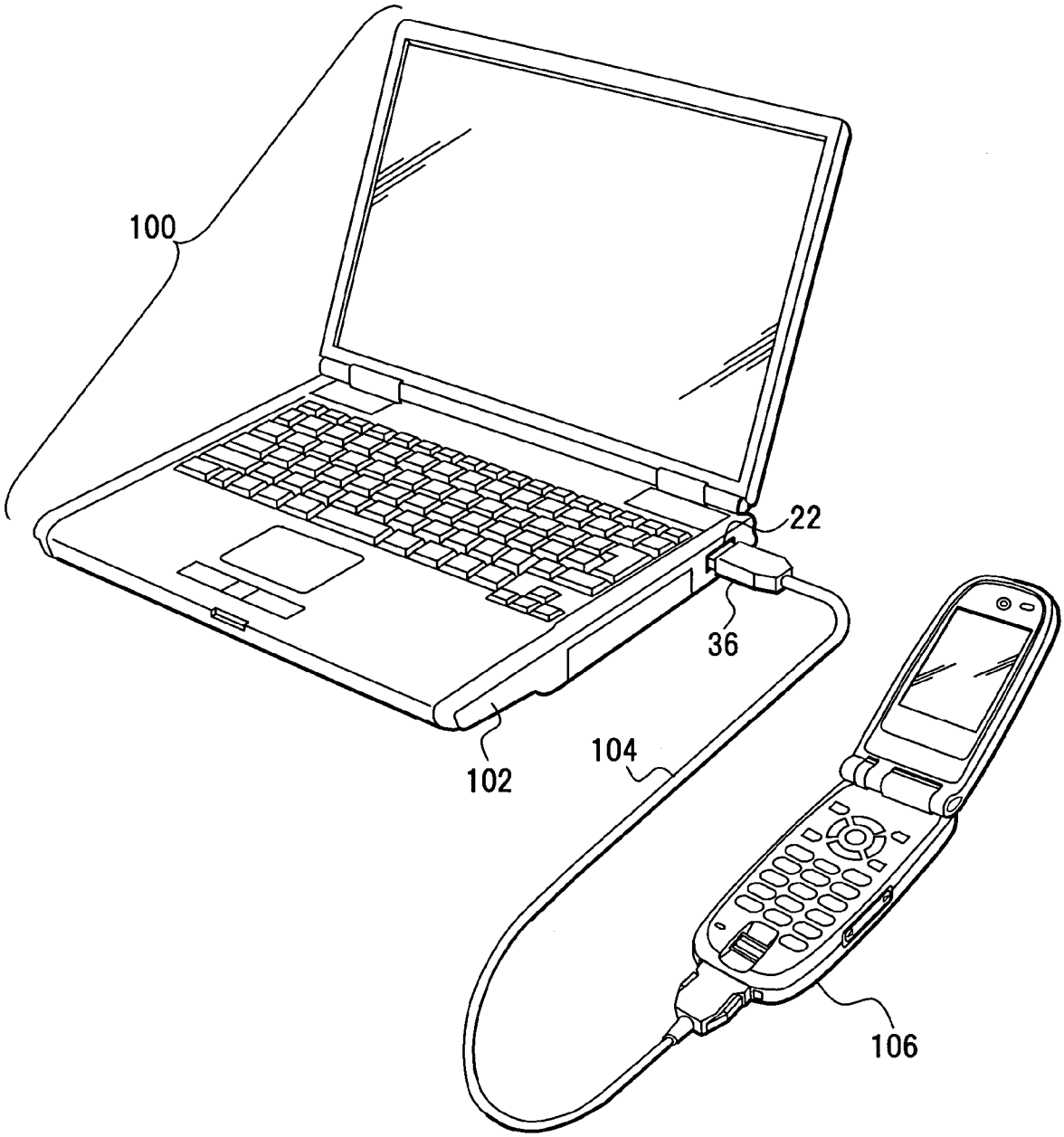
FIG. 20 shows an electronic apparatus according to a seventh embodiment.

A seventh embodiment of the present invention will be described with reference to FIG. 20. FIG. 20 shows exemplary structure of a connector and an electronic apparatus mounted with a circuit board where a connector is mounted. In FIG. 20, the same components as described in FIG. 5 are denoted by the same reference numerals.

The above described connector 22 and the above described circuit board 48 (FIG. 5) are mounted on a housing 102 of a portable personal computer (PC) 100, for example, as the above described electronic apparatus 46. The plug 36 attached to a USB cable 104 is equipped with the connector 22. A portable terminal device 106 is connected to the connector 22 via the USB cable 104.

If the PC 100 is carried in a state connecting such portable terminal device 106 via the USB cable 104, there is a case that exceeding external impact is given to the connector 22 of the PC 100 via the USB cable 104 and the plug 36. In this case, because the connector 22 has the above described structure, the external force is buffered from the inner shell 24 with being received by the elasticity set with angle θ of the giving rise to the cuts parts 94 composing the elasticity supporters 86 (FIG. 15). Thus, a fixing part of the outer shell 26 can be prevented from the exceeding impact, the solder part 54 can be prevented from separation and cracks, and the reliability of connection can be maintained. Inconvenience such that breakage of the connector 22 disables the PC 100 can also be avoided and the above described connector 22 contributes maintenance of the reliability of the PC 100.

In the above embodiments, a receptacle connector is disclosed. The present invention can be applied not only to the receptacle connector, but also to an independent formed connector from the circuit board 48. For example, if support structure that the inner shell 24 is supported to be movable slightly to the outer shell 26 attached to an insulating housing of the connector 22 (FIGS. 3 and 15) is adopted, the same effects can be expected.

While the most preferred embodiments of the present invention have been described, the description is not intended to limit the present invention. Various modifications and revisions can be made by those skilled in the art in accordance with the points and gist of the invention that are described in the claims or disclosed in the specification. These modifications and revisions surely fall within the true scope of the present invention.

The present invention relates generally to structure of a connector that is connected with uniting to a plug. Particularly, the present invention can be used in a plug connection of a connector that includes a buffer function of stress operating on the connector via a connection cable, etc., of a circuit board including the connector and of an electronic apparatus including the connector.

What is claimed is:

1. A connector for connection to a plug, the connector comprising: a first housing having contacts to be connected to corresponding contacts of the plug;

and a second housing that surrounds the first housing and is attached to an electrically-connected member to be attached, wherein the first housing is elastically supported inside the second housing by a cantilever structure.

2. The connector of claim 1, wherein a single or a plurality of support members that have elasticity are installed between the first housing and the second housing, and the first housing is supported via the support member by the second housing.

3. The connector of claim 2, wherein the support members are configured by an elasticity material.

4. The connector of claim 2, wherein the first housing, the second housing and the support members are formed by a metal plate.

5. The connector of claim 2, wherein the support members are an elastic body separated from an elasticity piece formed at the first housing or the second housing, the first housing or the second housing.

6. The connector of claim 1, wherein the cantilever structure connect the first housing and the second housing.

7. The connector of claim 1, wherein an elasticity member is intervened between a single or a plurality of opposed walls of the first housing and the second housing.

8. The connector of claim 1, wherein the first housing and the second housing have an opening corresponding to the plug at a surface perpendicular to another surface which is opposite to the member to be attached.

9. The connector of claim 8, wherein the first housing has a fulcrum of the cantilever at an opposite surface side to the surface side of the opening.

* * * * *